United States Patent [19]

Wilcox

[11] 4,027,888

[45] June 7, 1977

[54] VARIABLE CONTOUR SEATING DEVICE

[76] Inventor: Thomas J. Wilcox, Rte. 1, Box 334, East Troy, Wis. 53120

[22] Filed: Jan. 30, 1976

[21] Appl. No.: 653,896

[52] U.S. Cl. ..... 297/284; 297/456

[51] Int. Cl.[2] ..... A47C 7/02

[58] Field of Search ..... 5/365, 370; 297/284, 297/456

[56] References Cited

UNITED STATES PATENTS 3,893,731 7/1975 Maggs ..... 297/456

*Primary Examiner*—James C. Mitchell

*Attorney, Agent, or Firm*—Michael, Best & Friedrich

[57] ABSTRACT

The seating device has an elongated sack-like cover of a flexible material, such as an upholstery fabric, forming a cavity which is loosely filled with a freely flowable filler material, such as small spherical beads of expanded polystyrene. The cover includes a pair of generally vertical, opposed side panels, each of which has enlarged curvate end portions and a constricted intermediate portion, and an elongated center panel which is joined at its opposed longitudinal sides to the perimeter of the side panels to form a longitudinal, body supporting, upper surface having a generally convex enlarged end area adapted to serve as a backrest, another generally convex enlarged end area adapted to serve as a leg rest and a generally concave intermediate area adapted to support the derriere of the occupant. The contour of the supporting surface can be adjusted back and forth between a substantially upright sitting position and a substantially fully reclined position by selectively applying external pressure on one or more of the areas to cause the filler material to flow from and into selected areas and thereby alter the contour of the selected areas relative to one another.

7 Claims, 4 Drawing Figures

VARIABLE CONTOUR SEATING DEVICE

BACKGROUND OF THE INVENTION

This invention relates to seating devices and, more particularly, to variable contour seating devices including an outer cover which is loosely filled with a filler material.

Seating devices consisting of a bag or sack-like cover loosely filled with a solid filler material are known. These so-called "bean bag" devices typically have a generally circular or oval seating surface. The contour of the seating surface can be varied by displacing the filler material by hand prior to sitting and/or by the occupant sitting on the seating surface and wiggling his derriere. However, these bean bag devices are designed primarily for use only as a seat and usually do not have a definable initial shape.

SUMMARY OF THE INVENTION

The seating device of this invention is capable of being used much like a reclining chair, sofa or couch and the contour of the supporting surface thereof can be varied between a substantially upright sitting position and a substantially reclined position. This is accomplished by providing an elongated sack-like cover of a flexible material forming a cavity which is loosely filled with a freely flowable filler material. The cover includes a pair of generally vertical side panels, each of which has enlarged curvate end portions and a constricted intermediate portion, and an elongated center panel having its opposed longitudinal sides joined to the perimeter of the side panels to provide a longitudinal, body supporting, upper surface having a generally convex end area adapted to serve as a backrest, another generally convex end area adapted to serve as a leg rest area and a generally concave intermediate area adapted to support the derriere of the occupant. The contour of the body supporting surface can be varied by selectively applying external pressure on one or more of the areas to cause the filler material to flow from and to selected areas and thereby alter the contour of the selected areas relative to one another and from an initial shape.

DESCRIPTION OF THE PREFERRED EMBODIMENTS

Figure 1:
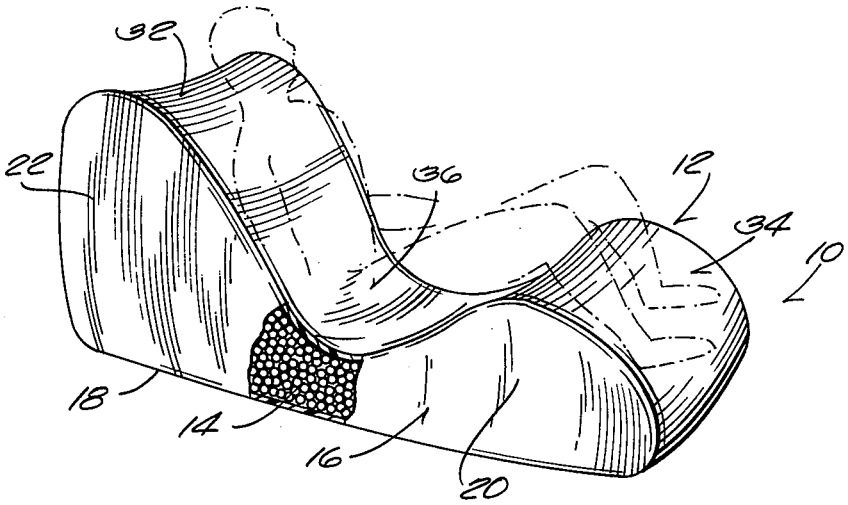
FIG. 1 is a perspective view of a variable contour seating device embodying various of the features of the invention, shown in an upright sitting position.
Figure 2:
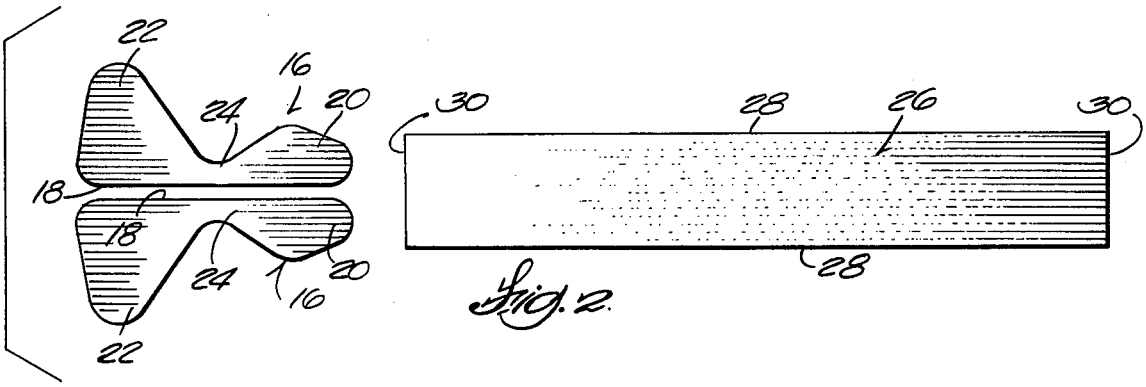
FIG. 2 are plan views of the patterns for the side panels and the center panel of the variable contour seating device of FIG. 1 prior to assembly.
Figure 3:
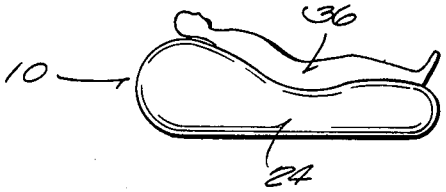
FIG. 3 is a reduced side view of the variable contour seating device of FIG. 1 shown in an inclined position.

Referring to FIGS. 1–3, the seating device 10 includes an elongated sack-like cover 12 which is made from a flexible material, such as an upholstery fabric, a plastic upholstery material, leather or the like, and is loosely filled with a freely flowable filler material 14. To minimize weight and cost of the device, the filler material preferably is a foamed or expanded plastic material and, to facilitate the flow of the filler material for changing the contour of the device as explained below, the filler material preferably is in the form of relatively small spherical beads, e.g., 1/32 to 3/16 inch diameter. Spherical beads of expanded polystyrene are particularly suitable as the filler material. The polystyrene beads can be coated or impregnated with a suitable lubricant, such as Teflon or silicone, to minimize the coefficient friction therebetween and thereby further enhance their flowability for changing the contour. Alternately, a suitable solid lubricant, such as magnesium stearate and talcum, can be used for this purpose, in which case the solid lubricant is mixed with the beads prior to introduction into the cover to provide a thin film of the solid lubricant over the outer surface of the beads.

In the embodiment illustrated in FIGS. 1–3, the cover 12 includes a pair of generally opposed side panels 16, each of which has a generally straight lower edge 18, enlarged curvate end portions 20 and 22, and a constricted intermediate portion 24, and further includes an elongated, rectangular center panel 26. The center panel 26, which preferably is one piece, is joined at its opposed longitudinal sides or edges 28 to the perimeter of the side panels 16, such as by stitching, cementing, etc., to form a cavity into which the filler material is introduced. The opposite ends of the center panel preferably are located on the bottom and are joined together with a suitable fastening means (not shown), such as snaps or a zipper, to provide a closable opening for introducing the filler material into or removing the filler material from the cavity. If desired, the ends 30 of the center panel 26 can be permanently joined together and a separate closable opening provided in the center panel or on one or both of the side panels.

As mentioned above, the cover cavity is loosely filled with the filler material. For instance, when spherical beads are used as the filler material, sufficient room is left in the interior of the cover to permit the beads to roll freely over and among themselves so that contour or shape of the device can be easily adjusted by the occupant.

After the cover 12 has been loosely filled with a filler material, the seating device 10 usually will have the initial shape shown in FIG. 1. The upper surface of the center panel 26 provides a longitudinal, body supporting, upper surface including a generally convex end area 32 which is adapted to serve as a backrest, a generally convex end area 34 which is adapted to serve as a leg rest area and a generally concave intermediate area 36 adapted to support the derriere of the occupant. In order to be capable of providing a substantially upright sitting position, the end portion 22 of the side panel 16 forming the backrest area preferably has a vertical height somewhat larger than the vertical height of the end portion 20 forming the leg rest area.

Assuming the device is in the shape illustrated in FIG. 1, an occupant straddling the device and easing his derriere into the intermediate area 36 initially will be sitting in a substantially upright position with his back resting against the backrest area 32 and his legs resting on the leg rest area 34. The occupant can adjust the contour of the body supporting surface towards the inclined position shown in FIG. 3, while sitting or lying on the device, by simply lifting his derriere so that pressure is relieved from the intermediate area 36 and applying pressure with his shoulders on the backrest area 32, preferably with some wiggling action to enhance movement of the filler material, and/or applying pressure with his legs on the leg rest area 34.

This causes the filler material to flow inside the cover cavity, primarily in a longitudinal direction, from the backrest area and/or the leg rest area into the intermediate area 36 with a resultant increase of the vertical height of the intermediate area and a decrease in the vertical height of the backrest area and/or the leg rest area. Thus, the contour of the body support surface is altered to provide a more reclined body position, the intermediate area supporting the derriere being raised and the backrest area supporting the head, shoulders and back being lowered. The amount of recline depends upon the amount of pressure the occupant applies with his shoulders, back and legs. The vertical height to which the intermediate area 36 is increased is limited by the constricted portions 24 of the side panels 16 becoming taut.

The occupant can return to a substantially upright position by lifting his head and shoulders to an upright position, thereby transferring the bulk of his weight to the intermediate area 36 and causing the filler material to flow from the intermediate area 36 into the backrest area 32 and/or the leg rest area 34. Movement of the filler material can be enhanced by the occupant wiggling his derriere. As can be appreciated, portions of the side panels will bulge to some degree as the contour is changed.

The contour of the seating device can be changed before sitting or lying on the device by manually applying an external pressure on the appropriate selected areas to cause the desired flow of filler material from one area to another.

Figure 4:
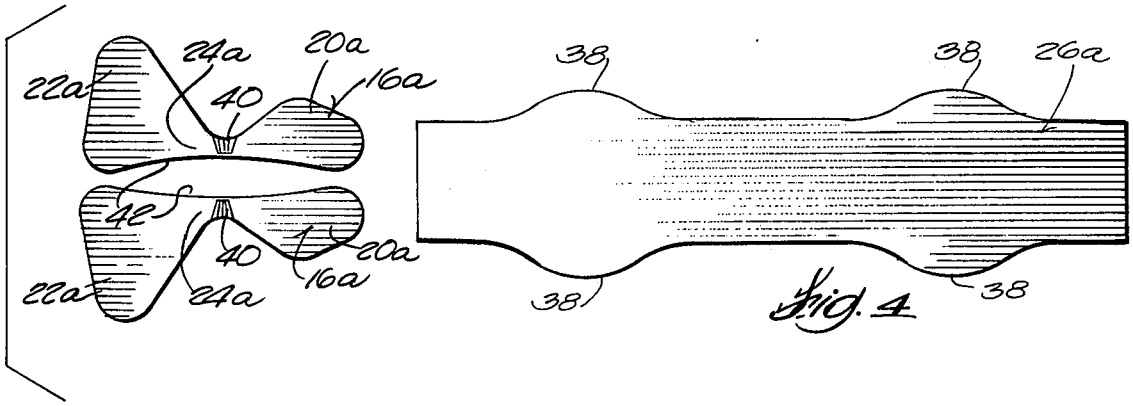
FIG. 4 are plan views of the patterns for alternate arrangements of the side panels and the center panel.

FIG. 4 illustrates alternate constructions of the center panel and the side panels to improve adjustability of the contour, i.e., facilitate movement of the filler material into and from the intermediate area 36. Instead of the center panel having a uniform width as shown in FIG. 2, each side of the center panel **26*a* is provided with bulged areas 38 at locations where the center panel joins the top and bottom of the intermediate portions 24 of the side panels. This in effect enlarges the cavity for the filler material in the intermediate area, thereby permitting easier movement of the filler material from and into the intermediate area. To this same end, the side panel 16*a* can be provided with a small strip of elastic material 40 at the constricted portion 24*a* which stretches and permits the intermediate area to expand vertically to a greater extent when the filler material is forced thereinto. Further, the bottom edge 42 of each side panel 16*a* can be contoured, i.e., provided with a convex shape, so that the bottom of the intermediate area 24*a* tends to raise off the supporting structure as the intermediate portions of the side panels 16*a* become taut during flow of material into the intermediate area 36,** thereby permitting the device to assume a more reclined position.

It should be understood that the modified center panel **26*a* shown in FIG. 4 can be used with side panels having the shape shown in FIGS. 1 and 2, with or without the elastic strips 40, and that the modified side panels 16*a* having a contoured bottom edge as shown in FIG. 4 can be used with a center panel having a uniform width as shown in FIGS. 1 and 2, with or without the elastic strips 40.**

From the above description, it can be seen that the variable contour seating device of this invention functions more like a reclining chair, couch or sofa and has a definable initial shape rather than simply a loosely defined seat like typical prior bean bag devices. The simple, lightweight construction makes it inexpensive to manufacture and permits it to be conveniently moved from one location to another. The device can be used as such without further support by allowing it to rest directly on the floor or it can be placed on a support, such as a solid base including legs, to space it above the floor at a more convenient height. To facilitate cleaning of the cover, especially when it is made from a fabric, a thin liner of plastic or the like for containing the filler material can be provided so that the filler material can be conveniently removed and replaced after the cover has been cleaned.

When expanded polystyrene beads are used as the filler material, they may tend to become somewhat compressed or flattened with use in which case additional beads may be added.

I claim:

1. A variable contour seating device comprising an elongated sack-like cover of a flexible material forming a cavity which is loosely filled with a freely flowable filler material, said cover including a pair of generally vertical, opposed side panels, each of which has enlarged curvate end portions and a constricted intermediate portion, and an elongated center panel having its opposed longitudinal sides joined to the perimeter of said side panels so as to provide a longitudinal body supporting upper surface having a generally convex first enlarged end portion adapted to serve as a backrest area, a generally convex second enlarged end portion adapted to serve as a leg rest area, and a generally concave intermediate area adapted to support the derriere of the occupant, the vertical height of said enlarged curvate end portions being greater than the vertical height of said constricted intermediate portions so that the vertical heights of said backrest area and said leg rest area are always greater than the vertical height of said intermediate area, whereby an occupant lying on said body supporting surface can vary the contour thereof by selectively shifting his weight from one to another of said areas so as to cause said filler material to flow in a longitudinal direction from said intermediate area and decrease the vertical height of said intermediate area when weight is shifted onto said intermediate area, and to flow into said intermediate area and increase the vertical height of said intermediate area when weight is shifted from said intermediate area, and can thereby selectively alter the contour of said areas relative to one another and from and back to the initial shape of said seating device imparted by reason of the construction features recited above.

2. A seating device according to claim 1 wherein said filler material comprises a plurality of generally spherical beads made from a synthetic plastic material.

3. A seating device according to claim 2 wherein said beads are formed from an expanded polystyrene.

4. A seating device according to claim 1 wherein each of said side panels includes a strip of elastic material located at said constricted portion and adapted to permit vertical stretching of said constricted portion.

5. A seating device according to claim 1 wherein said center panel is one piece.

6. A seating device according to claim 1 wherein said center panel is generally rectangular except for opposed bulge sections on the longitudinal sides thereof at the location adjoining said panel constricted portion.

7. A seating device according to claim 1 wherein the lower edge of each of said side panels has a convex shape.

* * * * *